United States Patent [19]

Nubani et al.

[11] 4,058,875

[45] Nov. 22, 1977

[54] METHOD OF ASSEMBLING A MASK-PANEL ASSEMBLY OF A SHADOW-MASK CATHODE-RAY TUBE

[75] Inventors: Jawdat Ibrahim Nubani, Clarks Summit; Walter Robert Rysz, Moosic, both of Pa.

[73] Assignee: RCA Corporation, New York, N.Y.

[21] Appl. No.: 715,372

[22] Filed: Aug. 18, 1976

[51] Int. Cl.[2] ..... H01J 9/18

[52] U.S. Cl. ..... 29/25.15; 29/25.13

[58] Field of Search ..... 29/424, 25.13, 25.15; 427/154, 106; 316/17, 19

[56] References Cited

U.S. PATENT DOCUMENTS

| | | | |
|---|---|---|---|
| 3,335,479 | 8/1967 | Morrell | 29/25.15 X |
| 3,712,700 | 1/1973 | Sommer | 427/154 X |
| 3,823,024 | 7/1974 | Cogliano | 427/154 |
| 3,871,739 | 3/1975 | Paulsen | 427/154 X |

*Primary Examiner*—Richard B. Lazarus

*Attorney, Agent, or Firm*—G. H. Bruestle; L. Greenspan

[57] ABSTRACT

Prior to mounting the mask in its prescribed position spaced from the inner surface of the panel, the panel surface is coated with a film of an organic material to improve the resistance of that surface to abrasion and bruising. The film is volatilizable when heated in air at temperatures up to about 400° C so that it is easily removable by baking.

10 Claims, 6 Drawing Figures

METHOD OF ASSEMBLING A MASK-PANEL ASSEMBLY OF A SHADOW-MASK CATHODE-RAY TUBE

BACKGROUND OF THE INVENTION

This invention relates to a novel method of assembling a mask-panel assembly of a shadow-mask cathode-ray tube.

Most commercial shadow-mask cathode-ray tubes comprise a glass faceplate panel including a viewing window. Such tubes, which are used in color-television receivers, include also a luminescent screen supported on the inner surface of the viewing window, and a shadow mask mounted on the panel and located at a predetermined, precisely-spaced position with respect to the inner surface of the viewing window.

In one method for assembling such tubes, the panel includes integral glass sidewalls extending from the periphery of the window, with metal studs implanted in the inner surface of the sidewalls. Metallic springs are permanently mounted on the mask by welding and are detachably mounted on the studs. Mounting the mask includes the mounting of the springs to the mask and to the studs, and includes also a setting of the precise spacing $q$ of the mask from the inner surface of the window. The setting of the $q$, or $q$-setting as it is called in the art, is adequately described in the prior art; for example, in U.S. Pat. Nos. 3,296,625 to T. M. Shrader et al and 3,701,193 to F. R. Ragland. Most $q$-setting involves the positioning and removal of a spacer between, and in physical contact with, the panel inner surface and the mask during the final welding step of mounting the springs to the mask. Also, measuring devices may be temporarily placed between the mask and window surface to check the spacing.

The panel with the mask properly spaced from the window and mounted within the panel is referred to as a mask-panel assembly. This mask-panel assembly may be baked for such temperatures and times as to dimensionally stabilize the assembly, as described in U.S. Pat. No. 3,335,479 to A. M. Morrell, after which the luminescent screen is deposited on the inner surface of the window by a photographic technique, usually using the mask as a photographic master.

During the steps involved in mounting the mask and the subsequent steps for the measuring of $q$, the inner surfaces of many of the viewing windows may be abraded or bruised, which damages usually manifest themselves as clearly-visible optical blemishes in the viewing field of the window, usually near the edges of the viewing windows. Such abrasions and bruises may result from accidental bumping or rubbing of the inner window surface by solid objects or from the misuse of spacers and/or measuring devices used during and after mounting.

SUMMARY OF THE INVENTION

The novel method for assembling a mask-panel assembly for a shadow-mask cathode-ray tube includes, prior to $q$-setting, precoating the inner surface of the panel of the assembly with a film of organic material. The film is volatilizable when heated in air at temperatures up to about 400° C so that it may easily be removed by baking. After precoating, the mask of the assembly is mounted in the panel in the usual way at a predetermined space position relative to the inner surface of the panel. Then, the panel is baked in air at temperatures sufficient to volatilize the film.

The film, which is preferably a polyvinyl alcohol, is preferably thin so that it has a negligible effect on the spacing of the mask from the inner surface of the window. However, and surprisingly, even a thin film provides the panel surface with substantial resistance to abrasion and bruising during and after the $q$-setting step.

DETAILED DESCRIPTION OF THE PREFERRED EMBODIMENT

Figure 1:
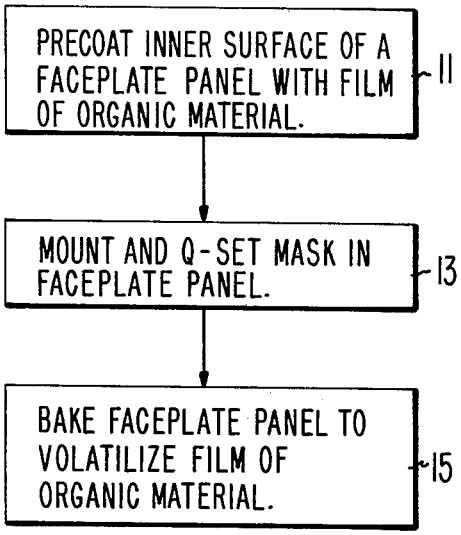
FIG. 1 is a flow sheet diagram illustrating the novel method including precoating the inner surface of the panel prior to mounting the mask in the panel.

FIG. 1 shows a typical process flow sheet diagram of the novel method. The inner surface of a faceplate panel, after removing loose particles and dust, is precoated with a film of organic material as shown in the box 11. Then, a mask is mounted and $q$-set in the faceplate panel as shown in the box 13. Then, the faceplate panel is baked in air to volatilize the film as shown in the box 15. This baking may occur before depositing the luminescent screen on the panel or after the luminescent screen has been deposited.

Figure 2:
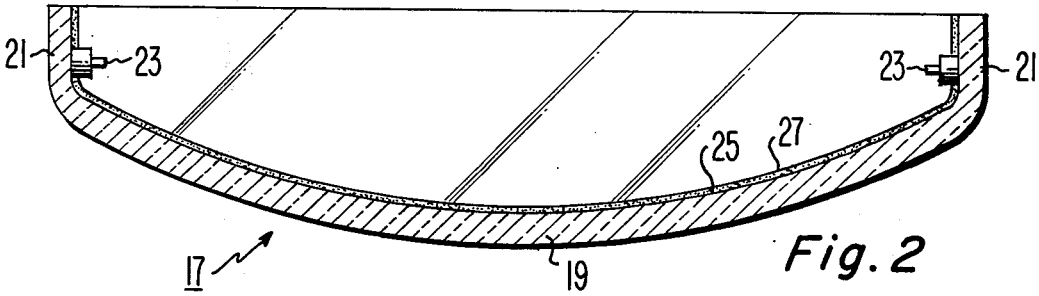
FIG. 2 is a sectional elevational view of a typical faceplate panel.

A typical rectangular faceplate panel 17 is shown in FIG. 2. It comprises a substantially-rectangular viewing window 19 and sidewalls 21 around the periphery of the window 19. Three or more mounting studs 23 are implanted in the inner sides of the sidewalls 21. The inner surface 25 of the window 19 is preferably stippled and is designed to support a luminescent viewing screen which is deposited thereon at a later step. It is this inner surface 25 which the novel method is designed to protect, since any damage to this surface may manifest itself as a clearly-visible blemish to the viewer of a finished tube.

The inner surface 25 is coated with a thin film 27 of organic material, which film can be volatilized by baking in air at temperatures below 400° C. Some suitable organic materials that can be used to form the film are polyvinyl acetates, polyvinyl pyrollidones, acrylate copolymers, nitrocellulose, low-temperature waxes, long-chain fatty acids, organic soaps and polyglycols. Films of polyvinyl alcohols are preferred because they are low in cost and can be formed from commercially-available aqueous solutions, which solutions are easily coated on the panels and which present no fire hazard during storage and coating. It is preferred to coat the surface 25 by spraying, although other coating methods, such as dipping and flow coating, may be used. By way of example, the surface 25 shown in FIG. 2 is air-sprayed with a 0.5 weight percent solution of polyvinyl alcohol and then dried in air to produce the film 27. For polyvinyl alcohols, the spray solution may have a concentration range of 0.1 to 1.0 weight percent polymer.

Figure 4:
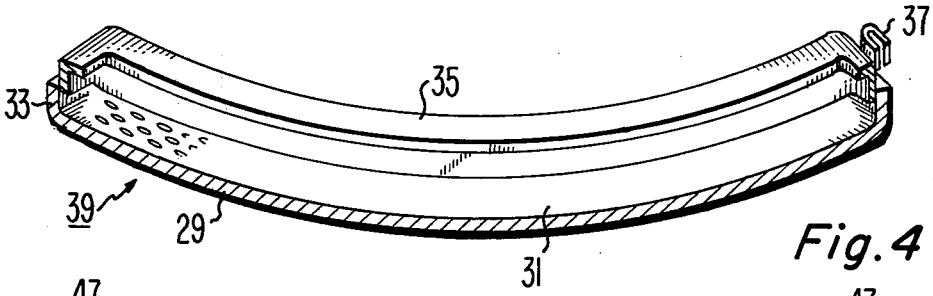
FIG. 4 is a sectional elevational view of a typical mask-frame assembly to be mounted into the panel shown in FIG. 2 using the spacer shown in FIG. 3.

The mask 29 to be *q*-set; that is, precisely spaced from the inner panel surface 25, is shown in FIG. 4. The mask 29 includes a dome-shaped apertured portion 31 and a perimetric skirt 33 which is welded to a frame 35. A hook plate 37 for each stud 23 in the panel 17 is welded to the frame. The combination 39 shown in FIG. 4 is commonly called a mask-frame assembly.

Figure 3:
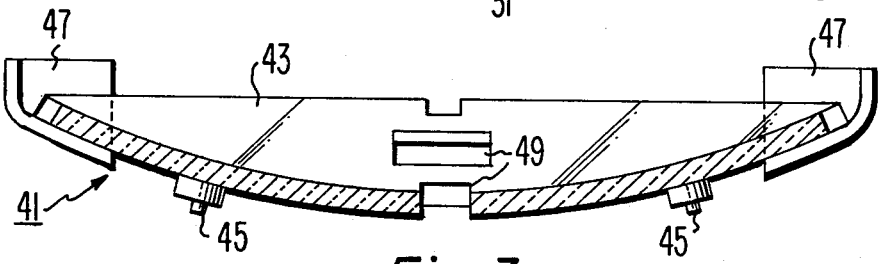
FIG. 3 is a sectional view of a typical spacer for use in $q$-setting.

After the film 27 has dried, a spacer 41 shown in FIG. 3 is placed in the panel 17. The spacer 41 is comprised of a base member 43 whose upper surface (as shown in FIG. 3) is contoured to receive the mask 31 to be spaced. The lower surface of the base member 43 has four legs 45 of such length as to provide the desired spacing between the panel surface 25 and the mask 31. Corner spacer brackets 47 are provided to center the mask-frame assembly 39 in the spacer 41. Hand holes 49 are provided in the base member 43 to facilitate the manual positioning and removal of the spacer. Thus, the spacer 41 may be picked up by the hand holes 49 and placed in the panel 17, with the four legs 45 contacting the film-coated inner surface 25 of the panel. Then, the mask-frame assembly 39 is placed manually on the spacer 41 with the mask 31 in contact with the upper surface of the base member 43.

Figure 5:
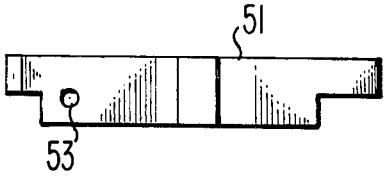
FIG. 5 is an elevational view of a spring to be used in mounting the mask-frame assembly shown in FIG. 4.
Figure 6:
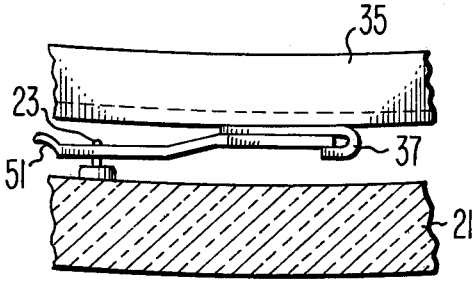
FIG. 6 is a fragmentary sectional view showing the relationship of a stud, a spring and the frame after mounting the assembly of FIG. 4 in the panel of FIG. 2.

A spring 51 having a hole 53, shown in FIG. 5, is now positioned on each stud 23 and adjacent a hook plate 37, as shown in FIG. 6. This can be achieved by placing the hole 53 on the stud 23 and rotating the spring 51 on the stud until it is in the desired position opposite the hook plate 37. With all of the parts so positioned, each spring 51 is welded to its adjacent hook plate 37, whereby the mask 29 is mounted and *q*-set in the panel 17. After welding, the spring 51 adjacent the stud 23 is depressed, and the mask-frame assembly 39 is removed from the panel 17. Then, the spacer 41 is removed from the panel 17.

A spacer-gauge assembly (not shown) may now be placed in the panel 17 and the mask-frame assembly 39 reinserted in the panel 17 with the springs 51 positioned on the studs 23. One suitable gauge is shown in FIGS. 6, 7 and 8 of U.S. Pat. No. 3,482,286 to G. L. Fassett et al. After checking the spacing, the mask-frame assembly 39 and the gauge are removed from the panel 17, and the mask-frame assembly 39 is again reinserted with the springs 51 positioned on the studs 23.

It will be noted that there are many opportunities for the inner surface 25 to be bruised and/or abraded. For example, if the spacer 41 is carelessly placed in or removed from the panel 17, the feet 45 and/or the corner spacer brackets 47 may bump or rub on the inner surface 25 of the panel 17. Also, if the gauge is carelessly placed in or removed from the panel 17, the gauge parts may bump and/or rub on the inner surface 25 of the panel. Also, after *q*-setting and/or gauging, if the mask-panel assembly 39 is carelessly reinserted into the panel 17, it may bump and/or rub the inner surface 25 of the panel. Also, during welding, hot metal may splash on the surface 25 and produce similar defects in the surface. In any of these cases, the bumping and/or rubbing and/or weld splash may produce a visible blemish in the viewing field of the window and be objectionable to a viewer. Such blemishes may be in the form of bruises and/or scratches.

In a study to determine the effect of the novel method, a standard test procedure for producing bruises and scratches at different places on each panel surface was used. During the test procedure, the panel surface was subjected to the dragging of a screw driver, scuffing by the mask during mask insertion, scuffing by the mask during mask removal, sliding during mask insertion and rocking the mask while mounted on the studs. The panels were examined visually with the aid of a flashlight. With panels that were untreated, scratching and abrasion were easily done and observed to be severe. Similar results were observed with panels whose surfaces were washed with acid but not precoated by the novel method. On the other hand, panels which were precoated according to the novel method, with or without a prior acid wash, showed good scratch resistance, showing only very light scratches under similar conditions.

Panels were then tested on a Hoffman Scratch Hardness Tester, Model SG-1610-M, and the data is summarized as follows:

| Panel Treatment | Pressure Required to Scratch Panel |
|---|---|
| Untreated | 75 grams |
| Acid Washed | 75 grams |
| Polymer Coated | 125 grams |
| Acid Washed and Polymer Coated | 150 grams |

In a subsequent test on several thousands of panels, the percent of panels rejected for internal scratches and/or bruises was about 0.13% for precoated panels according to the novel method and about 2.22% for panels not precoated according to the novel method.

We are aware that it is old to precoat the inner surface of a faceplate panel with organic material prior to depositing a luminescent screen thereon. See, for example, Canadian Pat. No. 602,838 to W. W. Slobbe and U.S. Pat. No. 3,966,474 to S. A. Harper. However, such prior precoating is done for a different purpose, and that purpose is to improve the uniformity of deposition and the adherence of the luminescent screen to the surface, and not to improve scratch and abrasion resistance of the surface. Also, such prior precoating is applied after mounting and *q*-setting the mask and would not aid in reducing panel rejects produced at that stage of assembly.

We claim:

1. In a method for assembling a mask-panel assembly for a shadow-mask cathode-ray tube, the steps in the following order:

a. precoating the inner surface of the panel of said assembly with a film of organic material, which film is volatilizable when heated in air at temperatures up to about 400° C, b. mounting the mask of said assembly in said panel at a predetermined spaced position relative to said inner surface, c. and then baking said panel in air at temperatures sufficient to volatilize said film.

2. The method defined in claim 1 wherein said organic material is polyvinyl alcohol.

3. The method defined in claim 2 wherein said baking step (*c*) is conducted at such temperatures and for such times as to dimensionally stabilize said panel and mask assembly.

4. In a method for manufacturing a cathode-ray tube comprising a faceplate panel including a viewing window having an inner surface, a luminescent viewing screen on said surface and a mask mounted in said panel at a predetermined position spaced from said inner surface, the steps in the following order:

a. precoating said inner surface of said panel with a film of organic material, which film is volatilizable when heated in air at temperatures up to about 400° C, b. mounting said mask in said panel, c. baking said panel in air at temperatures sufficient to volatilize said film d. and then depositing said viewing screen on the inner surface of said viewing window.

5. The method defined in claim 4 wherein step (*a*) is conducted by spraying said organic material while in an aqueous medium.

6. The method defined in claim 4 wherein step (*a*) is conducted by spraying an aqueous solution of polyvinyl alcohol.

7. The method defined in claim 6 wherein said polyvinyl alcohol constitutes about 0.1 to 1.0 weight percent of said solution.

8. The method defined in claim 6 wherein said polyvinyl alcohol constitutes about 0.5 weight percent of said solution.

9. The method defined in claim 4 including washing said inner surface with acid prior to said step of precoating.

10. The method defined in claim 4 wherein said mask is supported on a frame and step (*b*) comprises the steps in the following order:

i. positioning a spacer in contact with said inner surface, ii. positioning said mask supported on said frame in contact with said spacer, iii. detachably mounting a spring to said panel, and permanently mounting said spring to said frame, iv. and removing said spacer.

* * * * *